US005554478A

United States Patent [19]

Kuramoto et al.

[11] Patent Number: 5,554,478

[45] Date of Patent: Sep. 10, 1996

[54] ELECTROPHOTOGRAPHIC DRY TONER

[75] Inventors: Shinichi Kuramoto, Numazu; Yoshihisa Okamoto, Fuji; Yasuo Asahina, Numazu; Michio Izumi, Numazu; Hidefumi Gohhara, Numazu; Chiharu Mochizuki, Numazu; Tomomi Suzuki, Gotenba; Hideo Nakamura; Masaru Wakisaka, both of Ichihara, all of Japan

[73] Assignees: Ricoh Company, Ltd.; Mitsui Petrochemical Industries, Ltd., both of Tokyo, Japan

[21] Appl. No.: 273,185

[22] Filed: Jul. 11, 1994

[30] Foreign Application Priority Data

Jul. 12, 1993 [JP] Japan ..... 5-171505
Jul. 4, 1994 [JP] Japan ..... 6-152054

[51] Int. Cl.[6] ..... G03G 9/087

[52] U.S. Cl. ..... 430/109

[58] Field of Search ..... 430/110, 109, 430/137

[56] References Cited

U.S. PATENT DOCUMENTS

| | | | |
|---|---|---|---|
| 4,762,763 | 8/1988 | Nomura et al. | 430/110 |
| 4,913,991 | 4/1990 | Chiba et al. | 430/45 |
| 4,933,250 | 6/1990 | Nakayama et al. | 430/106 |
| 4,980,258 | 12/1990 | Aoki et al. | 430/110 |
| 5,043,387 | 8/1991 | Nakamura et al. | 528/113 |
| 5,061,588 | 10/1991 | Fushimi et al. | 430/109 |
| 5,126,221 | 6/1992 | Chiba et al. | 430/45 |
| 5,238,767 | 8/1993 | Horiie | 430/110 |
| 5,294,682 | 3/1994 | Fukuda et al. | 525/442 |
| 5,344,732 | 9/1994 | Chiba et al. | 430/42 |

*Primary Examiner*—John Goodrow
*Attorney, Agent, or Firm*—Cooper & Dunham LLP

[57] ABSTRACT

A dry toner for use in electrophotography including a coloring agent and a polyol resin serving as a binder resin, which has a main chain portion containing an epoxy resin moiety and an alkylene oxide moiety, and protected terminal portions bonded to the main chain portion.

7 Claims, No Drawings

ELECTROPHOTOGRAPHIC DRY TONER

BACKGROUND OF THE INVENTION

1. Field of the Invention

The present invention relates to a dry toner for use in electrophotography.

2. Discussion of Background

In accordance with a dry-type electrophotographic method, latent electrostatic images are formed on a photoconductor by a conventional method, and the latent electrostatic images are developed into visible toner images with a dry toner. Then, the toner images are transferred to a sheet of copy paper and fixed thereon, for instance, by the application of heat using heat-application means such as a heated roller.

The dry toner for use with the above-mentioned electrophotographic method comprises a binder resin and a coloring agent as the main components, and when necessary, may further comprise other additives such as a charge controlling agent and an offset-preventing agent. When various characteristics required for the dry toner, namely, transparency, electrical insulating properties, water resistance, fluidity of particles, mechanical strength, glossiness, thermoplasticity, and grindability are taken into consideration, polystyrene, styrene-acrylic copolymer, polyester resin and epoxy resin are generally used as the binder agents for the dry toner. In particular, styrene-based resins are widely employed because the grindability, water resistance and fluidity are superior to others. However, in the case where toner images are formed on a sheet of copy paper using a toner comprising the styrene-based resin as the binder resin, and thereafter the toner-image-bearing sheet is held between a document folder made from a vinyl chloride resin for a long period of time, the vinyl chloride folder is stained with the toner images when the toner-image-bearing sheet is taken out of the folder. The reason for this problem is that a plasticizer contained in the vinyl chloride resin is transferred to the toner images and plasticizes the same while the toner images are brought into contact with the vinyl chloride folder. Consequently, the toner images are partially or entirely peeled from the copy paper and attached to the vinyl chloride folder. The same problem as mentioned above is produced when the toner comprising the polyester resin as the binder resin is employed.

To solve the above-mentioned problem, it is proposed to mix the styrene-based resin or polyester resin with an epoxy resin which is not plasticized by the plasticizer for use in the vinyl chloride resin, as disclosed in Japanese Laid-Open Patent Applications 60-263951 and 61-24025.

However, when different kinds of resins are contained in a toner composition, especially for a color toner, the offset properties, pigmentation, light transmission properties and coloring characteristics considerably deteriorate because of incompatibility between the different kinds of resins. Furthermore, a toner-image-bearing sheet readily curls after image-fixing process, and the glossiness of the obtained toner image decreases. The color toner images which are not provided with appropriate gloss appear to be poor in quality.

All the aforementioned problems cannot be solved by using not only any conventionally known epoxy resin, but also an acetyl-modified epoxy resin as disclosed in Japanese Laid-Open Patent Application 61-235852.

In the case where the epoxy resin is used alone as the binder resin in the dry toner, the reactivity of the epoxy resin and amine causes some problems.

More specifically, the epoxy resin is commonly used as a cured resin in such a manner that epoxy group in the epoxy resin is allowed to react with a curing agent to form a crosslinking structure, so that excellent mechanical strength and chemical resistance can be imparted to the cured epoxy resin. The above-mentioned curing agent is roughly classified into two groups, that is, an amine-containing compound and an organic acid anhydride.

When the epoxy resin serving as the thermoplastic resin is kneaded with an amine-containing dye, pigment or charge controlling agent for the preparation of a toner composition, there is the problem that the epoxy resin may cause the crosslinking reaction with such an amine-containing component in the kneading process. The toner thus obtained is not available for use in practice. Further, the epoxy resin irritates the skin because of the biochemical activity of epoxy group, so that it is necessary to handle the epoxy resin with the utmost care.

Furthermore, water absorption of the epoxy resin becomes striking under the circumstances of high temperature and humidity because of the hydrophilic nature of epoxy group. Under such circumstances, therefore, the charging characteristics of the toner are decreased, the toner deposition on the background of the photoconductor takes place, and the cleaning of the photoconductor cannot be successfully carried out. In addition, the charging stability of the toner is poor when the epoxy resin is used as the binder resin in the toner.

To prepare a toner composition, a mixture of a coloring agent such as a dye or pigment, a charge controlling agent and a binder resin is generally kneaded in a heated roll mill to uniformly disperse the coloring agent and the charge controlling agent in the binder resin. Some dyes and pigments have the charge controlling characteristics, and such dyes and pigments function both as the coloring agent and the charge controlling agent. When the epoxy resin is used as the binder resin, it is difficult to thoroughly disperse the coloring agent and the charge controlling agent in the epoxy resin. Poor dispersion of the coloring agent decreases the pigmentation and impairs the coloring characteristics of the toner. In addition, when the charge controlling agent is not sufficiently dispersed in the binder resin, the toner cannot uniformly be charged. Consequently, the charging failure occurs, the toner deposition on the background and scattering of toner particles in the copying machine easily take place, the obtained toner images are lacking in image density and evenness, and the cleaning of the photoconductor cannot be successfully carried out.

There is proposed a toner comprising as a binder resin an ester-modified epoxy resin which is prepared by reacting an epoxy resin and $\epsilon$-caprolactone, as disclosed in Japanese Laid-Open Patent Application 61-219051. In this case, the transfer of the toner image formed on the copy paper toward a vinyl chloride material can be prevented, and the fluidity of toner particles can be increased. However, the amount of the ester-modified epoxy resin is as high as 15 to 90 wt. % of the entire weight of the epoxy resin, so that the softening point of the obtained toner is extremely decreased, and the obtained images become too glossy.

A positively-chargeable resin for use in the toner is proposed, as disclosed in Japanese Laid-Open Patent Application 52-86334, which resin is obtained by allowing aliphatic primary or secondary amine to react with terminal epoxy group of a conventional epoxy resin. However, the epoxy group and the amine cause the crosslinking reaction, as previously described, so that the toner thus prepared may not be suitable for use in practice.

As disclosed in Japanese Laid-Open Patent Application 52-156632, it is proposed that at least one terminal epoxy group of the epoxy resin is allowed to react with an alcohol, a phenol, a Grignard reagent, an organic acid, a sodium acetylide, and an alkyl chloride. In this case, when one of the terminal epoxy groups is not capped, the problems of the reactivity of the epoxy group with amine, the toxicity, and the hydrophilic nature remain unsolved. In addition, all of the above-mentioned reaction products of the epoxy resin are not effective as the binder resin for use in the dry toner because some of them are hydrophilic, or have an adverse effect on the charging characteristics and the grindability of the toner.

As disclosed in Japanese Laid-Open Patent Application 1-267560, a resin for use in the toner is prepared by allowing both terminal epoxy groups of an epoxy resin to react with an active-hydrogen-containing monovalent compound, and esterifying the reaction product thus obtained by use of a monocarboxylic acid or ester derivatives thereof, and a lactone. Although the problems of the reactivity with amine, the toxicity, and the hydrophilic nature, of the epoxy resin can be solved, the curling problem of the toner image after image-fixing remains unsolved.

SUMMARY OF THE INVENTION

Accordingly, a first object of the present invention is to provide an electrophotographic dry toner capable of producing images with excellent color reproducibility and uniform glossiness.

A second object of the present invention is to provide a dry toner which is unsusceptible to an amine compound and biochemically stable.

A third object of the present invention is to provide a dry toner with excellent environmental stability.

A fourth object of the present invention is to provide a dry toner capable of producing toner images which are not transferred to a vinyl chloride sheet even when the toner images are brought into contact with the vinyl chloride sheet.

A fifth object of the present invention is to provide a dry toner capable of forming toner images on an image-receiving sheet through the image-fixing process without the curling problem.

The above-mentioned objects of the present invention can be achieved by a dry toner for use in electrophotography comprising a coloring agent, and a polyol resin serving as a binder resin, which comprises a main chain portion comprising an epoxy resin moiety and an alkylene oxide moiety, and protected terminal portions bonded to the main chain portion.

In the first mentioned electrophotographic dry toner, the polyol resin may be a reaction product of an epoxy resin, an alkylene oxide adduct of a dihydric phenol or a glycidyl ether of the alkylene oxide adduct, a compound including in the molecule thereof one active hydrogen atom which is capable of reacting with epoxy group, and a compound including in the molecule thereof at least two active hydrogen atoms which are capable of reacting with epoxy group.

In the second mentioned electrophotographic dry toner, the epoxy resin for use in the polyol resin may comprise at least two kinds of bisphenol A type epoxy resin components with different number-average molecular weights, which are obtained by polymerizing bisphenol A as a polymerizable monomer.

In the above-mentioned electrophotographic dry toner, the lowest of the number-average molecular weights of the bisphenol A type epoxy resin components may be in the range from 360 to 2,000, and the highest of the number-average molecular weights of the bisphenol A type epoxy resin components may be in the range from 3,000 to 10,000. In addition, the amount of the bisphenol A type epoxy resin component with the lowest number-average molecular weight may be in the range from 20 to 50 wt. % of the amount of the polyol resin, and the amount of the bisphenol A type epoxy resin component with the highest number-average molecular weight may be in the range from 5 to 40 wt. % of the amount of the polyol resin.

In the second mentioned dry toner, the alkylene oxide adduct of the dihydric phenol or glycidyl ether thereof may be a compound of formula (1):

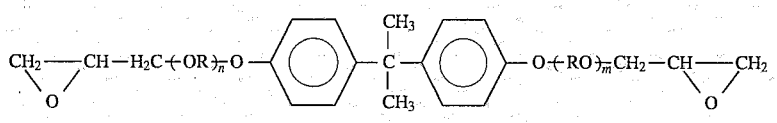

(1)

wherein R is $$-CH_2-CH_2-,\quad -CH_2-\underset{\underset{CH_3}{|}}{CH}-,\quad \text{or}\quad -CH_2-CH_2-CH_2-;$$

and n and m are integers of 1 or more, provided that (n+m) is 2 to 6.

In the second mentioned dry toner, the amount of the alkylene oxide adduct of the dihydric phenol or glycidyl ether thereof may be in the range of 10 to 40 wt. % of the amount of the polyol resin.

DESCRIPTION OF THE PREFERRED EMBODIMENTS

The polyol resin for use in the dry toner of the present invention comprises a main chain portion comprising an alkylene oxide moiety and an epoxy resin moiety, and protected terminal portions bonded to the main chain portion. Therefore, the environmental stability and image-fixing properties of the dry toner are improved. In addition, the toner image is not transferred to a vinyl chloride sheet although the toner image is brought into contact with the vinyl chloride sheet. Furthermore, when the binder resin for use in the present invention is used for a color toner composition, the color images with excellent color reproducibility and uniform glossiness can be obtained, and these color images are fixed on an image-receiving medium without curling problem.

The aforementioned polyol resin may be a reaction product of (1) an epoxy resin, (2) an alkylene oxide adduct of a dihydric phenol or a glycidyl ether of the alkylene oxide adduct, (3) a compound including in the molecule thereof one active hydrogen atom which is capable of reacting with epoxy group, and (4) a compound including in the molecule thereof at least two active hydrogen atoms which are capable of reacting with epoxy group.

An epoxy resin prepared by allowing a bisphenol, for example, bisphenol A or bisphenol F, to react with epichlorohydrin is preferably employed for the preparation of the polyol resin for use in the present invention.

To obtain stable image-fixing properties and uniform glossiness of the obtained images, it is preferable that the epoxy resin for use in the polyol resin comprise at least two kinds of epoxy resin components with different number-average molecular weights, which are obtained by polymerizing bisphenol A as a polymerizable monomer. This kind of epoxy resins will be referred to as bisphenol A type epoxy resins.

In the case where a plurality of bisphenol A type epoxy resin components are employed for the preparation of the polyol resin, the lowest of the number-average molecular weights of the bisphenol A type epoxy resin components is preferably in the range from 360 to 2,000, and the highest of the number-average molecular weights of the bisphenol A type epoxy resin components is preferably in the range from 3,000 to 10,000. In addition, the amount of the bisphenol A type epoxy resin component with the lowest number-average molecular weight is preferably in the range from 20 to 50 wt. % of the amount of the polyol resin, and the amount of the bisphenol A type epoxy resin component with the highest number-average molecular weight is preferably in the range from 5 to 40 wt. % of the amount of the polyol resin.

When the number-average molecular weight and the amount ratio of the bisphenol A type epoxy resin component with the lowest molecular weight are controlled within the above range, the glossiness of the obtained toner image is proper for use in practice, and the preservability of the toner is not decreased. When the number-average molecular weight and the amount ratio of the bisphenol A type epoxy resin component with the highest molecular weight are controlled within the above range, the proper glossiness of the toner image can be obtained and the image-fixing properties of the toner image are not decreased.

As the alkylene oxide adduct of the dihydric phenol used to prepare the polyol resin, a reaction product of an alkylene oxide such as ethylene oxide, propylene oxide, butylene oxide or a mixture thereof, and a bisphenol such as bisphenol A or bisphenol F is available. The alkylene oxide adduct of the dihydric phenol thus obtained may be allowed to react with epichlorohydrin or β-methylepichlorohydrin. In particular, a diglycidyl ether of the alkylene oxide adduct of bisphenol A having the following formula (1) is preferable:

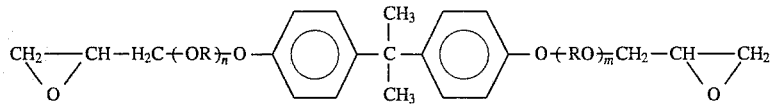

(1)

wherein R is $$-CH_2-CH_2-,\quad -CH_2-\underset{\underset{CH_3}{|}}{CH}-,\ \text{or}\quad -CH_2-CH_2-CH_2-;$$

and n and m are integers of 1 or more, provided that (n+m) is 2 to 6.

It is preferable that the amount of the alkylene oxide adduct of the dihydric phenol or the glycidyl ether of the alkylene oxide adduct be in the range of 10 to 40 wt. % of the amount of the polyol resin. In the case where the amount ratio of the alkylene oxide adduct of the dihydric phenol or the glycidyl ether thereof is within the above range, the curling problem can efficiently be prevented. In addition, when the sum of n and m in formula (1) is within the range from 2 to 6, the toner image can be provided with a proper glossiness, and the decrease of preservability of the toner can be avoided.

As the compound including in the molecule thereof one active hydrogen atom which is capable of reacting with epoxy group, which is used to prepare the polyol resin, a monohydric phenol, a secondary amine and a carboxylic acid can be employed.

Examples of the monohydric phenol are phenol, cresol, isopropylphenol, aminophenol, nonylphenol, dodecylphenol, xylenol, and p-cumylphenol.

Examples of the secondary amine are diethylamine, dipropylamine, dibutylamine, N-methyl(ethyl)-piperazine and piperidine.

Examples of the carboxylic acid are propionic acid and caproic acid.

The combination of various kinds of materials is possible to obtain the polyol resin for use in the present invention which has an epoxy resin moiety and an alkylene oxide moiety in the main chain thereof. For instance, an epoxy resin having at both ends glycidyl group and an alkylene oxide adduct of a dihydric phenol having at both ends glycidyl group may be allowed to react with a dihalide, diisocyanate, diamine, dithiol, polyhydric phenol, or dicarboxylic acid. Particularly, the reaction with a dihydric phenol is most preferable from the viewpoint of reaction stability. In this case, it is also preferable that the dihydric phenol may be used in combination with a polyhydric phenol and a polyvalent carboxylic acid as long as the obtained reaction product does not set to gel. The amount of the polyhydric phenol and polyvalent carboxylic acid is preferably 15 wt. % or less, more preferably 10 wt. % or less, of the entire weight of the dihydric phenol, the polyhydric phenol and the polyvalent carboxylic acid.

For the compound including in the molecule thereof at least two active hydrogen atoms which are capable of reacting with epoxy group, a dihydric phenol, a polyhydric phenol and a polyvalent carboxylic acid can be employed.

Specific examples of the dihydric phenol are bisphenol A and bisphenol F.

Specific examples of the polyhydric phenol are o-cresol novolak, phenol novolak, tris(4-hydroxyphenyl)methane, and 1-[α-methyl-α-(4-hydroxyphenyl)ethyl]benzene.

Specific examples of the polyvalent carboxylic acid are malonic acid, succinic acid, glutaric acid, adipic acid, maleic acid, fumaric acid, phthalic acid, terephthalic acid, trimellitic acid, and anhydrotrimellitic acid.

Any conventionally known dyes and pigments can be used as the coloring agents for use in the dry toner of the present invention. Examples of the dyes and pigments are carbon black, nigrosine dyes, black iron oxide, Naphthol Yellow S, Hansa Yellow (10G, 5G, G), cadmium yellow, yellow iron oxide, yellow ochre, chrome yellow pigment, Titan Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, Anthragen Yellow BGL, isoindolinone yellow, red oxide, red lead oxide, red lead, cadmium red, cadmium mercury red, antimony red, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chrome oxide green, Persian, emerald green, Pigment Green B, Naphthol Green B, Green Gold, Acid Green Lake, Malachite Green Lake, Phthalocyanine Green, Anthraquinone Green, titanium oxide, zinc white, and lithopone. These dyes and pigments can be used in combination.

It is preferable that the amount of the coloring agent be in the range of 0.1 to 50 parts by weight to 100 parts by weight of the binder resin.

The dry toner according to the present invention may further comprise a charge controlling agent. Any conventional charge controlling agents can be used in the present invention. For instance, a nigrosine dye, a triphenylmethane dye, a chromium-containing metal complex dye, a molybdic acid chelate pigment, a rhodamine dye, an alkoxyamine, a quaternary ammonium salt including a fluorine-modified quaternary ammonium salt, alkylamide, phosphorus and a phosphorus-containing compound, tungsten and a tungsten-containing compound, a fluorine-containing active material, and a metallic salt of salicylic acid and a metallic salt of a salicylic acid derivative are usable.

In addition, the toner of the present invention may further comprise additives, for example, colloidal silica, hydrophobic silica, fatty acid metallic salts such as zinc stearate and aluminum stearate, metallic oxides such as titanium oxide, aluminum oxide, tin oxide and antimony oxide, and fluoropolymers.

The dry toner of the present invention can be used for a one-component developer, or a two-component developer in combination with a carrier component. For the carrier component, the conventionally known materials such as iron powders, ferrite particles and glass beads can be employed. These carrier particles may be coated with a resin, such as polyfluorocarbon, polyvinyl chloride, polyvinylidene chloride, phenolic resin, polyvinyl acetal or silicone resin. In this case, it is proper that the amount of the toner be in the range of 0.5 to 6.0 parts by weight to 100 parts by weight of the carrier.

Other features of this invention will become apparent in the course of the following description of exemplary embodiments which are given for illustration of the invention and are not intended to be limiting thereof.

Synthesis Example 1

Synthesis of polyol resin No. 1

A mixture of the following components was placed in a separable flask equipped with a stirrer, a thermometer, a nitrogen-introducing inlet and a condenser:

| | Weight |
|---|---|
| Bisphenol A type epoxy resin (with a number-average molecular weight of about 360) | 378.4 g |
| Bisphenol A type epoxy resin (with a number-average molecular weight of about 2700) | 86.0 g |
| Diglycidyl ether of bisphenol A type propylene oxide addition product having formula (1) in which the sum of n and m is about 2.1 | 191.0 g |
| Bisphenol F | 274.5 g |
| p-cumylphenol | 70.1 g |
| Xylene | 200 g |

The above mixture was heated to 70° to 100° C. in a stream of nitrogen, and 0.183 g of lithium chloride was added thereto. After the mixture was further heated to 160° C., xylene was distilled away from the reaction mixture under reduced pressure. Then, the polymerization was carried out at a reaction temperature of 180° C. for 6 to 9 hours. Thus, 1000 g of a polyol resin No. 1 were obtained. The softening temperature and glass transition temperature of the polyol resin No. 1 were respectively 109° C. and 58° C.

Synthesis Example 2

Synthesis of polyol resin No. 2

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 360) | 205.3 g |
| Bisphenol A type epoxy resin (with a number-average molecular weight of about 3000) | 54.0 g |
| Diglycidyl ether of bisphenol A type propylene oxide addition product having formula (1) in which the sum of n and m is about 2.2 | 432.0 g |
| Bisphenol F | 282.7 g |
| p-cumylphenol | 26.0 g |
| Xylene | 200 g |

Thus, 1000 g of a polyol resin No. 2 were obtained. The softening temperature and glass transition temperature of the polyol resin No. 2 were respectively 109° C. and 58° C.

Synthesis Example 3

Synthesis of polyol resin No. 3

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 360) | 252.6 g |
| Bisphenol A type epoxy resin (with a number-average molecular weight of about 10000) | 112.0 g |
| Diglycidyl ether of bisphenol A type ethylene oxide addition product having formula (1) in which the sum of n and m is about 5.9 | 336.0 g |
| Bisphenol AD | 255.3 g |
| p-cumylphenol | 44.1 g |
| Xylene | 200 g |

Thus, 1000 g of a polyol resin No. 3 were obtained. The softening temperature and glass transition temperature of the polyol resin No. 3 were respectively 109° C. and 58° C.

Synthesis Example 4

Synthesis of polyol resin No. 4

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 2400) | 289.9 g |
| Bisphenol A type epoxy resin (with a number-average molecular weight of about 10000) | 232.0 g |
| Diglycidyl ether of bisphenol A type ethylene oxide addition product having formula (1) in which the sum of n and m is about 6.0 | 309.0 g |
| Bisphenol AD | 117.5 g |
| p-cumylphenol | 51.6 g |
| Xylene | 200 g |

Thus, 1000 g of a polyol resin No. 4 were obtained. The softening temperature and glass transition temperature of the polyol resin No. 4 were respectively 116° C. and 61° C.

Synthesis Example 5

Synthesis of polyol resin No. 5

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 680) | 421.5 g |
| Bisphenol A type epoxy resin (with a number-average molecular weight of about 6500) | 107.0 g |
| Diglycidyl ether of bisphenol A type ethylene oxide addition product having formula (1) in which the sum of n and m is about 2.0 | 214.0 g |
| Bisphenol F | 210.0 g |
| p-cumylphenol | 47.5 g |

-continued

| | Weight |
|---|---|
| Xylene | 200 g |

Thus, 1000 g of a polyol resin No. 5 were obtained. The softening temperature and glass transition temperature of the polyol resin No. 5 were respectively 114° C. and 60° C.

Synthesis Example 6

Synthesis of polyol resin No. 6

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 680) | 203.0 g |
| Bisphenol A type epoxy resin (with a number-average molecular weight of about 6500) | 58.0 g |
| Diglycidyl ether of bisphenol A type ethylene oxide addition product having formula (1) in which the sum of n and m is about 2.2 | 462.0 g |
| Bisphenol F | 254.6 g |
| p-cumylphenol | 22.4 g |
| Xylene | 200 g |

Thus, 1000 g of a polyol resin No. 6 were obtained. The softening temperature and glass transition temperature of the polyol resin No. 6 were respectively 112° C. and 59° C.

Synthesis Example 7

Synthesis of polyol resin No. 7

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 680) | 370.6 g |
| Bisphenol A type epoxy resin (with a number-average molecular weight of about 6500) | 306.0 g |
| Diglycidyl ether of bisphenol A type ethylene oxide addition product having formula (1) in which the sum of n and m is about 5.8 | 102.0 g |
| Bisphenol AD | 110.2 g |
| p-cumylphenol | 111.2 g |
| Xylene | 200 g |

Thus, 1000 g of a polyol resin No. 7 were obtained. The softening temperature and glass transition temperature of the polyol resin No. 7 were respectively 118° C. and 62° C.

Synthesis Example 8

Synthesis of polyol resin No. 8

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 680) | 238.4 g |
| Bisphenol A type epoxy resin (with a number-average molecular weight of about 6500) | 231.0 g |
| Diglycidyl ether of bisphenol A type ethylene oxide addition product having formula (1) in which the sum of n and m is about 6.0 | 308.0 g |
| Bisphenol AD | 168.9 g |
| p-cumylphenol | 53.7 g |
| Xylene | 200 g |

Thus, 1000 g of a polyol resin No. 8 were obtained. The softening temperature and glass transition temperature of the polyol resin No. 8 were respectively 118° C. and 62° C.

Synthesis Example 9

Synthesis of polyol resin No. 9

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 680) | 401.9 g |
| Bisphenol A type epoxy resin (with a number-average molecular weight of about 6500) | 242.0 g |
| Diglycidyl ether of bisphenol A type ethylene oxide addition product having formula (1) in which the sum of n and m is about 2.0 | 134.0 g |
| Bisphenol F | 166.0 g |
| p-cumylphenol | 56.1 g |
| Xylene | 200 g |

Thus, 1000 g of a polyol resin No. 9 were obtained. The softening temperature and glass transition temperature of the polyol resin No. 9 were respectively 112° C. and 59° C.

Synthesis Example 10

Synthesis of polyol resin No. 10

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 680) | 200.7 g |

-continued

| | Weight |
|---|---|
| Bisphenol A type epoxy resin (with a number-average molecular weight of about 6500) | 158.0 g |
| Diglycidyl ether of bisphenol A type ethylene oxide addition product having formula (1) in which the sum of n and m is about 2.1 | 351.0 g |
| Bisphenol F | 182.4 g |
| p-cumylphenol | 107.9 g |
| Xylene | 200 g |

Thus, 1000 g of a polyol resin No. 10 were obtained. The softening temperature and glass transition temperature of the polyol resin No. 10 were respectively 112° C. and 59° C.

Synthesis Example 11

Synthesis of polyol resin No. 11

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 460) | 430.0 g |
| Bisphenol A type epoxy resin (with a number-average molecular weight of about 6500) | 188.0 g |
| Diglycidyl ether of bisphenol A type ethylene oxide addition product having formula (1) in which the sum of n and m is about 5.9 | 116.0 g |
| Bisphenol F | 209.2 g |
| p-cumylphenol | 56.8 g |
| Xylene | 200 g |

Thus, 1000 g of a polyol resin No. 11 were obtained. The softening temperature and glass transition temperature of the polyol resin No. 11 were respectively 107° C. and 57° C.

Synthesis Example 12

Synthesis of polyol resin No. 12

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 680) | 218.8 g |
| Bisphenol A type epoxy resin (with a number-average molecular weight of about 6500) | 172.0 g |
| Diglycidyl ether of bisphenol A type ethylene oxide addition product having formula (1) in which the sum of n and m is about 6.0 | 382.0 g |
| Bisphenol F | 176.8 g |
| p-cumylphenol | 50.4 g |
| Xylene | 200 g |

Thus, 1000 g of a polyol resin No. 12 were obtained. The softening temperature and glass transition temperature of the polyol resin No. 12 were respectively 112° C. and 59° C.

Synthesis Example 13

Synthesis of polyol resin No. 13

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 680) | 275.4 g |
| Bisphenol A type epoxy resin (with a number-average molecular weight of about 6500) | 194.0 g |
| Diglycidyl ether of bisphenol A type ethylene oxide addition product having formula (1) in which the sum of n and m is about 2.3 | 269.0 g |
| Bisphenol AD | 203.5 g |
| p-cumylphenol | 58.1 g |
| Xylene | 200 g |

Thus, 1000 g of a polyol resin No. 13 were obtained. The softening temperature and glass transition temperature of the polyol resin No. 13 were respectively 114° C. and 60° C.

Synthesis Example 14

Synthesis of polyol resin No. 14

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 680) | 244.5 g |
| Bisphenol A type epoxy resin (with a number-average molecular weight of about 6500) | 188.0 g |
| Diglycidyl ether of bisphenol A type ethylene oxide addition product having formula (1) in which the sum of n and m is about 7.9 | 348.0 g |
| Bisphenol AD | 169.9 g |
| p-cumylphenol | 49.6 g |
| Xylene | 200 g |

Thus, 1000 g of a polyol resin No. 14 were obtained. The softening temperature and glass transition temperature of the polyol resin No. 14 were respectively 112° C. and 59° C.

Synthesis Example 15

Synthesis of polyol resin No. 15

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 680) | 258.3 g |
| Bisphenol A type epoxy resin (with a number-average molecular weight of about 6500) | 199.0 g |
| Diglycidyl ether of bisphenol A type ethylene oxide addition product having formula (1) in which the sum of n and m is about 4.2 | 276.0 g |
| Bisphenol A | 198.3 g |
| p-cumylphenol | 68.3 g |
| Xylene | 200 g |

Thus, 1000 g of a polyol resin No. 15 were obtained. The softening temperature and glass transition temperature of the polyol resin No. 15 were respectively 114° C. and 60° C.

Synthesis Example 16

Synthesis of polyol resin No. 16

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 400) | 156.1 g |
| Bisphenol A type epoxy resin (with a number-average molecular weight of about 6500) | 350.0 g |
| Diglycidyl ether of bisphenol A type propylene oxide addition product having formula (1) in which the sum of n and m is about 4.0 | 230.0 g |
| Bisphenol A | 119.7 g |
| p-cumylphenol | 144.1 g |
| Xylene | 200 g |

Thus, 1000 g of a polyol resin No. 16 were obtained. The softening temperature and glass transition temperature of the polyol resin No. 16 were respectively 114° C. and 60° C.

Synthesis Example 17

Synthesis of polyol resin No. 17

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 2000) | 17.6 g |
| Bisphenol A type epoxy resin (with a number-average molecular weight of about 11000) | 423.0 g |
| Diglycidyl ether of bisphenol A type propylene oxide addition product having formula (1) in which the sum of n and m is about 6.2 | 385.0 g |
| Bisphenol F | 109.6 g |
| p-cumylphenol | 64.7 g |

-continued

| | Weight |
|---|---|
| Xylene | 200 g |

Thus, 1000 g of a polyol resin No. 17 were obtained. The softening temperature and glass transition temperature of the polyol resin No. 17 were respectively 118° C. and 62° C.

Synthesis Example 18

Synthesis of polyol resin No. 18

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 340) | 438.1 g |
| Bisphenol A type epoxy resin (with a number-average molecular weight of about 3000) | 54.0 g |
| Diglycidyl ether of bisphenol A type ethylene oxide addition product having formula (1) in which the sum of n and m is about 1.9 | 108.0 g |
| Bisphenol AD | 347.9 g |
| p-cumylphenol | 51.9 g |
| Xylene | 200 g |

Thus, 1000 g of a polyol resin No. 18 were obtained. The softening temperature and glass transition temperature of the polyol resin No. 18 were respectively 112° C. and 59° C.

Synthesis Example 19

Synthesis of polyol resin No. 19

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 400) | 251.2 g |
| Bisphenol A type epoxy resin (with a number-average molecular weight of about 6500) | 50.0 g |
| Diglycidyl ether of bisphenol A type ethylene oxide addition product having formula (1) in which the sum of n and m is about 2.0 | 400.0 g |
| Bisphenol F | 276.0 g |
| p-cumylphenol | 22.7 g |
| Xylene | 200 g |

Thus, 1000 g of a polyol resin No. 19 were obtained. The softening temperature and glass transition temperature of the polyol resin No. 19 were respectively 112° C. and 59° C.

Synthesis Example 20

Synthesis of polyol resin No. 20

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 680) | 82.3 g |
| Bisphenol A type epoxy resin (with a number-average molecular weight of about 6500) | 683.0 g |
| Diglycidyl ether of bisphenol A type ethylene oxide addition product having formula (1) in which the sum of n and m is about 4.0 | 125.0 g |
| Bisphenol A | 9.3 g |
| p-cumylphenol | 180.0 g |
| Xylene | 200 g |

Thus, 1000 g of a polyol resin No. 20 were obtained. The softening temperature and glass transition temperature of the polyol resin No. 20 were respectively 118° C. and 63° C.

Synthesis Example 21

Synthesis of polyol resin No. 21

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 680) | 428.7 g |
| Bisphenol A type epoxy resin (with a number-average molecular weight of about 6500) | 318.0 g |
| Diglycidyl ether of bisphenol A type ethylene oxide addition product having formula (1) in which the sum of n and m is about 3.8 | 21.0 g |
| Bisphenol A | 92.3 g |
| p-cumylphenol | 140.0 g |
| Xylene | 200 g |

Thus, 1000 g of a polyol resin No. 21 were obtained. The softening temperature and glass transition temperature of the polyol resin No. 21 were respectively 114° C. and 60° C.

Synthesis Example 22

Synthesis of polyol resin No. 22

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 680) | 411.9 g |

-continued

| | Weight |
|---|---|
| Diglycidyl ether of bisphenol A type ethylene oxide addition product having formula (1) in which the sum of n and m is about 3.8 | 350.0 g |
| Bisphenol A | 199.2 g |
| p-cumylphenol | 38.9 g |
| Xylene | 200 g |

Thus, 1000 g of a polyol resin No. 22 were obtained. The softening temperature and glass transition temperature of the polyol resin No. 22 were respectively 113° C. and 58° C.

Synthesis Example 23

Synthesis of polyol resin No. 23

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 680) | 480.2 g |
| Bisphenol A type epoxy resin (with a number-average molecular weight of about 6500) | 287.0 g |
| Bisphenol A | 106.8 g |
| p-cumylphenol | 126.0 g |
| Xylene | 200 g |

Thus, 1000 g of a polyol resin No. 23 were obtained. The softening temperature and glass transition temperature of the polyol resin No. 23 were respectively 111° C. and 59° C.

Synthesis Example 24

Synthesis of polyol resin No. 24

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 400) | 303 g |
| Bisphenol A type epoxy resin (with a number-average molecular weight of about 5300) | 135 g |
| Diglycidyl ether of bisphenol A type propylene oxide addition product having formula (1) in which the sum of n and m is about 2.1 | 230 g |
| Bisphenol A | 172 g |
| p-cumylphenol | 144 g |
| o-cresol novolak "OCN80" (Trademark) made by Nippon Kayaku Co., Ltd. with a softening point of 80.4° C., and OH equivalent of 139 g/eq. | 20 g |
| Xylene | 200 g |

Thus, 1000 g of a polyol resin No. 24 were obtained. The softening temperature and glass transition temperature of the polyol resin No. 24 were respectively 113° C. and 61° C.

Synthesis Example 25

Synthesis of polyol resin No. 25

The procedure for preparation of the polyol resin No. 1 in Synthesis Example 1 was repeated except that the materials for use in the reaction system used in Synthesis Example 1 were changed as follows:

| | Weight |
|---|---|
| Bisphenol A type epoxy resin (with a number-average molecular weight of about 400) | 324 g |
| Bisphenol A type epoxy resin (with a number-average molecular weight of about 5300) | 135 g |
| Diglycidyl ether of bisphenol A type propylene oxide addition product having formula (1) in which the sum of n and m is about 2.2 | 230 g |
| Bisphenol A | 216 g |
| p-cumylphenol | 73 g |
| Adipic acid | 30 g |
| Xylene | 200 g |

Thus, 1000 g of a polyol resin No. 25 were obtained. The softening temperature and glass transition temperature of the polyol resin No. 25 were respectively 111° C. and 60° C.

EXAMPLE 1

A mixture of the following components was separately kneaded with the application of heat thereto in a heated-roll mill. Thereafter, the mixture was cooled, and roughly ground in a hammer mill and finely pulverized in an air-jet mill, and then classified, so that yellow, magenta and cyan toner particles with an average particle diameter of 5 to 15 μm were obtained:

| | Parts by Weight |
|---|---|
| [Formulation for yellow toner] | |
| Polyol resin No. 1 | 100 |
| Yellow pigment "Lionol Yellow FGN-T" (Trademark), made by Toyo Ink Mfg. Co., Ltd. | 5 |
| Chromium complex of salicylic acid "E-81" (Trademark), made by Orient Chemical Industries, Ltd. | 1 |
| [Formulation for magenta toner] | |
| Polyol resin No. 1 | 100 |
| Red pigment "Lionogen Magenta R" (Trademark), made by Toyo Ink mfg. Co., Ltd. | 5 |
| Chromium complex of salicylic acid "E-81" (Trademark), made by Orient Chemical Industries, Ltd. | 1 |
| [Formulation for cyan toner] | |
| Polyol resin No. 1 | 100 |
| Blue pigment "Lionol Blue FG-7351" (Trademark), made by Toyo Ink Mfg. Co., Ltd. | 2 |
| Chromium complex of salicylic acid "E-81" (Trademark), made by Orient Chemical Industries, Ltd. | 1 |

Thus, yellow, magenta and cyan toners according to the present invention were obtained.

Five parts by weight of the toner of each color and 95 parts by weight of iron carrier powders "TEFV200/300" (Trademark), made by Nihon Teppun Co., Ltd. were mixed, so that a two-component developer was prepared.

The thus prepared three kinds of color developers were set in a commercially available electrophotographic color copying machine, and yellow, magenta and cyan images were separately obtained on a sheet of copy paper through the processes of development, image-transfer and image-fixing using a heated-roller. The toner image of a single color was clear and the average glossiness was 42%.

On the other hand, full-color toner images were formed on a sheet of copy paper by superimposing the three colors of toners. As a result, sharp full-color images with an average glossiness of 46% were obtained.

The lower limit and the upper limit of the temperature range in which toner images were fixed on a sheet of copy paper were respectively 115° C. and 180° C.

When a solid black image was entirely formed on a sheet of copy paper by superimposing the three color toners, the glossiness of the solid black image was even at the end portions of the copy paper although the end portions slightly curled.

In addition, when full-color images were formed on a transparent film for an overhead projector (OHP) and projected on a screen using the OHP, sharp full-color images were formed without muddiness.

To evaluate the preservability of the toner images, a vinyl chloride sheet was brought into contact with the full-color-image bearing surface of the copy paper at room temperature for 180 hours. As a result, the full-color toner images were maintained in a good condition without transferring to the vinyl chloride sheet.

Furthermore, a sample of each color toner weighing 10 g was placed in a 20-ml glass container and allowed to stand in a thermostat of 50° C. for 5 hours, and thereafter, the penetration was measured by a penetrometer. All samples showed a penetration of 15 or more.

EXAMPLE 2

The procedure for preparation of the yellow, magenta and cyan toners according to the present invention in Example 1 was repeated except that the polyol resin No. 1 for use in each toner formulation in Example 1 was replaced by the polyol resin No. 2, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 39%.

The full-color image formed on a sheet of copy paper by superimposing the three colors of toners was sharp and showed an average glossiness of 44%.

The lower limit and the upper limit of the temperature range in which toner images were fixed on a sheet of copy paper were respectively 115° C. and 180° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 12 or more.

EXAMPLE 3

The procedure for preparation of the yellow, magenta and cyan toners according to the present invention in Example 1 was repeated except that the polyol resin No. 1 for use in each toner formulation in Example 1 was replaced by the polyol resin No. 3, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 36%.

The full-color image formed on a sheet of copy paper by superimposing the three colors of toners was sharp and showed an average glossiness of 39%.

The lower limit and the upper limit of the temperature range in which toner images were fixed on a sheet of copy paper were respectively 115° C. and 185° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 18 or more.

EXAMPLE 4

The procedure for preparation of the yellow, magenta and cyan toners according to the present invention in Example 1 was repeated except that the polyol resin No. 1 for use in each toner formulation in Example 1 was replaced by the polyol resin No. 4, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 18%.

The full-color image formed on a sheet of copy paper by superimposing the three colors of toners was sharp and showed an average glossiness of 16%.

The lower limit and the upper limit of the temperature range in which toner images were fixed on a sheet of copy paper were respectively 130° C. and 200° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 20 or more.

EXAMPLE 5

The procedure for preparation of the yellow, magenta and cyan toners according to the present invention in Example 1 was repeated except that the polyol resin No. 1 for use in each toner formulation in Example 1 was replaced by the polyol resin No. 5, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 25%.

The full-color image formed on a sheet of copy paper by superimposing the three colors of toners was sharp and showed an average glossiness of 28%.

The lower limit and the upper limit of the temperature range in which toner images were fixed on a sheet of copy paper were respectively 120° C. and 195° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 18 or more.

EXAMPLE 6

The procedure for preparation of the yellow, magenta and cyan toners according to the present invention in Example 1 was repeated except that the polyol resin No. 1 for use in each toner formulation in Example 1 was replaced by the polyol resin No. 6, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 41%.

The full-color image formed on a sheet of copy paper by superimposing the three colors of toners was sharp and showed an average glossiness of 43%.

The lower limit and the upper limit of the temperature range in which toner images were fixed on a sheet of copy paper were respectively 115° C. and 180° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 12 or more.

EXAMPLE 7

The procedure for preparation of the yellow, magenta and cyan toners according to the present invention in Example 1 was repeated except that the polyol resin No. 1 for use in each toner formulation in Example 1 was replaced by the polyol resin No. 7, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 26%.

The full-color image formed on a sheet of copy paper by superimposing the three colors of toners was sharp and showed an average glossiness of 29%.

The lower limit and the upper limit of the temperature range in which toner images were fixed on a sheet of copy paper were respectively 120° C. and 195° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 18 or more.

EXAMPLE 8

The procedure for preparation of the yellow, magenta and cyan toners according to the present invention in Example 1 was repeated except that the polyol resin No. 1 for use in each toner formulation in Example 1 was replaced by the polyol resin No. 8, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 22%.

The full-color image formed on a sheet of copy paper by superimposing the three colors of toners was sharp and showed an average glossiness of 25%.

The lower limit and the upper limit of the temperature range in which toner images were fixed on a sheet of copy paper were respectively 120° C. and 195° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 18 or more.

EXAMPLE 9

The procedure for preparation of the yellow, magenta and cyan toners according to the present invention in Example 1 was repeated except that the polyol resin No. 1 for use in each toner formulation in Example 1 was replaced by the polyol resin No. 9, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 33%.

The full-color image formed on a sheet of copy paper by superimposing the three colors of toners was sharp and showed an average glossiness of 35%.

The lower limit and the upper limit of the temperature range in which toner images were fixed on a sheet of copy paper were respectively 115° C. and 185° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 15 or more.

EXAMPLE 10

The procedure for preparation of the yellow, magenta and cyan toners according to the present invention in Example 1 was repeated except that the polyol resin No. 1 or use in each toner formulation in Example 1 was replaced by the polyol resin No. 10, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 37%.

The full-color image formed on a sheet of copy paper by superimposing the three colors of toners was sharp and showed an average glossiness of 40%.

The lower limit and the upper limit of the temperature range in which toner images were fixed on a sheet of copy paper were respectively 115° C. and 180° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 15 or more.

EXAMPLE 11

The procedure for preparation of the yellow, magenta and cyan toners according to the present invention in Example 1 was repeated except that the polyol resin No. 1 for use in each toner formulation in Example 1 was replaced by the polyol resin No. 11, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 45%.

The full-color image formed on a sheet of copy paper by superimposing the three colors of toners was sharp and showed an average glossiness of 48%.

The lower limit and the upper limit of the temperature range in which toner images were fixed on a sheet of copy paper were respectively 110° C. and 175° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 10 or more.

EXAMPLE 12

The procedure for preparation of the yellow, magenta and cyan toners according to the present invention in Example 1 was repeated except that the polyol resin No. 1 for use in each toner formulation in Example 1 was replaced by the polyol resin No. 12, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 38%.

The full-color image formed on a sheet of copy paper by superimposing the three colors of toners was sharp and showed an average glossiness of 36%.

The lower limit and the upper limit of the temperature range in which toner images were fixed on a sheet of copy paper were respectively 115° C. and 180° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 10 or more.

EXAMPLE 13

The procedure for preparation of the yellow, magenta and cyan toners according to the present invention in Example 1 was repeated except that the polyol resin No. 1 for use in each toner formulation in Example 1 was replaced by the polyol resin No. 13, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 25%.

The full-color image formed on a sheet of copy paper by superimposing the three colors of toners was sharp and showed an average glossiness of 28%.

The lower limit and the upper limit of the temperature range in which toner images were fixed on a sheet of copy paper were respectively 120° C. and 195° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 18 or more.

EXAMPLE 14

The procedure for preparation of the yellow, magenta and cyan toners according to the present invention in Example 1 was repeated except that the polyol resin No. 1 for use in each toner formulation in Example 1 was replaced by the polyol resin No. 14, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 29%.

The full-color image formed on a sheet of copy paper by superimposing the three colors of toners was sharp and showed an average glossiness of 31%.

The lower limit and the upper limit of the temperature range in which toner images were fixed on a sheet of copy paper were respectively 120° C. and 195° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 18 or more.

EXAMPLE 15

The procedure for preparation of the yellow, magenta and cyan toners according to the present invention in Example 1 was repeated except that the polyol resin No. 1 for use in each toner formulation in Example 1 was replaced by the polyol resin No. 15, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 25%.

The full-color image formed on a sheet of copy paper by superimposing the three colors of toners was sharp and showed an average glossiness of 29%.

The lower limit and the upper limit of the temperature range in which toner images were fixed on a sheet of copy paper were respectively 120° C. and 195° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 18 or more.

EXAMPLE 16

The procedure for preparation of the yellow, magenta and cyan toners according to the present invention in Example 1 was repeated except that the polyol resin No. 1 for use in each toner formulation in Example 1 was replaced by the polyol resin No. 16, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 28%.

The full-color image formed on a sheet of copy paper by superimposing the three colors of toners was sharp and showed an average glossiness of 31%.

The lower limit and the upper limit of the temperature range in which toner images were fixed on a sheet of copy paper were respectively 120° C. and 195° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 18 or more.

EXAMPLE 17

The procedure for preparation of the yellow, magenta and cyan toners according to the present invention in Example 1 was repeated except that the polyol resin No. 1 for use in each toner formulation in Example 1 was replaced by the polyol resin No. 17, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 16%.

The full-color image formed on a sheet of copy paper by superimposing the three colors of toners was sharp and showed an average glossiness of 14%.

The lower limit and the upper limit of the temperature range in which toner images were fixed on a sheet of copy paper were respectively 130° C. and 210° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 20 or more.

EXAMPLE 18

The procedure for preparation of the yellow, magenta and cyan toners according to the present invention in Example 1 was repeated except that the polyol resin No. 1 for use in each toner formulation in Example 1 was replaced by the polyol resin No. 18, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 38%.

The full-color image formed on a sheet of copy paper by superimposing the three colors of toners was sharp and showed an average glossiness of 41%.

The lower limit and the upper limit of the temperature range in which toner images were fixed on a sheet of copy paper were respectively 110° C. and 180° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 10 or more.

EXAMPLE 19

The procedure for preparation of the yellow, magenta and cyan toners according to the present invention in Example 1 was repeated except that the polyol resin No. 1 for use in each toner formulation in Example 1 was replaced by the polyol resin No. 19, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 38%.

The full-color image formed on a sheet of copy paper by superimposing the three colors of toners was sharp and showed an average glossiness of 41%.

The lower limit and the upper limit of the temperature range in which toner images were fixed on a sheet of copy paper were respectively 115° C. and 180° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 10 or more.

EXAMPLE 20

The procedure for preparation of the yellow, magenta and cyan toners according to the present invention in Example 1 was repeated except that the polyol resin No. 1 for use in each toner formulation in Example 1 was replaced by the polyol resin No. 20, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 11%.

The full-color image formed on a sheet of copy paper by superimposing the three colors of toners was sharp and showed an average glossiness of 14%.

The lower limit and the upper limit of the temperature range in which toner images were fixed on a sheet of copy paper were respectively 130° C. and 200° C.

When a solid black image was entirely formed on a sheet of copy paper by superimposing the three color toners, the glossiness of the solid black image was slightly higher at the end portions, and the end portions of the copy paper slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 20 or more.

EXAMPLE 21

The procedure for preparation of the yellow, magenta and cyan toners according to the present invention in Example 1 was repeated except that the polyol resin No. 1 for use in each toner formulation in Example 1 was replaced by the polyol resin No. 21, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 25%.

The full-color image formed on a sheet of copy paper by superimposing the three colors of toners was sharp and showed an average glossiness of 29%.

The lower limit and the upper limit of the temperature range in which toner images were fixed on a sheet of copy paper were respectively 120° C. and 195° C.

When a solid black image was entirely formed on a sheet of copy paper by superimposing the three color toners, the glossiness of the solid black image was slightly higher at the end portions, and the end portions of the copy paper slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 18 or more.

EXAMPLE 22

The procedure for preparation of the yellow, magenta and cyan toners according to the present invention in Example 1 was repeated except that the polyol resin No. 1 for use in each toner formulation in Example 1 was replaced by the polyol resin No. 22, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 35%.

The full-color image formed on a sheet of copy paper by superimposing the three colors of toners was sharp and showed an average glossiness of 36%.

The lower limit and the upper limit of the temperature range in which toner images were fixed on a sheet of copy paper were respectively 125° C. and 175° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 18 or more.

EXAMPLE 23

The procedure for preparation of the yellow, magenta and cyan toners according to the present invention in Example 1 was repeated except that the polyol resin No. 1 for use in each toner formulation in Example 1 was replaced by the polyol resin No. 24, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 23%.

The full-color image formed on a sheet of copy paper by superimposing the three colors of toners was sharp and showed an average glossiness of 28%.

The lower limit and the upper limit of the temperature range in which toner images were fixed on a sheet of copy paper were respectively 120° C. and 200° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 18 or more.

EXAMPLE 24

The procedure for preparation of the yellow, magenta and cyan toners according to the present invention in Example 1 was repeated except that the polyol resin No. 1 for use in each toner formulation in Example 1 was replaced by the polyol resin No. 25, so that yellow, magenta and cyan toners according to the present invention were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 25%.

The full-color image formed on a sheet of copy paper by superimposing the three colors of toners was sharp and showed an average glossiness of 29%.

The lower limit and the upper limit of the temperature range in which toner images were fixed on a sheet of copy paper were respectively 120° C. and 200° C.

When a solid black image was entirely formed on a sheet of copy paper by superimposing the three color toners, the glossiness of the solid black image was even at the end portions of the copy paper although the end portions slightly curled.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 18 or more.

Comparative Example 1

The procedure for preparation of the yellow, magenta and cyan toners according to the present invention in Example 1 was repeated except that the polyol resin No. 1 for use in each toner formulation in Example 1 was replaced by the polyol resin No. 23, so that comparative yellow, magenta and cyan toners were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 26%.

The full-color image formed on a sheet of copy paper by superimposing the three colors of toners was sharp and showed an average glossiness of 24%.

The lower limit and the upper limit of the temperature range in which toner images were fixed on a sheet of copy paper were respectively 130° C. and 185° C.

When a solid black image was entirely formed on a sheet of copy paper by superimposing the three color toners, the glossiness of the solid black image was considerably high at the end portions of the copy paper, and the end portions of the copy paper curled to a high degree.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the full-color toner images were maintained in a good condition without transferring to the vinyl chloride sheet.

Furthermore, all toner samples showed a penetration of 18 or more.

Comparative Example 2

The procedure for preparation of the yellow, magenta and cyan toners according to the present invention in Example 1 was repeated except that the polyol resin No. 1 for use in each toner formulation in Example 1 was replaced by a polyester resin with an acid value of 4, a glass transition temperature of 61° C. and a softening point of 106° C., so that comparative yellow, magenta and cyan toners were prepared.

A two-component developer of each color was prepared and set in the same copying machine as employed in Example 1. Then, yellow, magenta and cyan images were separately obtained on a sheet of copy paper by the same method as in Example 1. The toner image of a single color was clear and the average glossiness was 52%.

The full-color image formed on a sheet of copy paper by superimposing the three colors of toners was sharp and showed an average glossiness of 48%.

The lower limit and the upper limit of the temperature range in which toner images were fixed on a sheet of copy paper were respectively 110° C. and 150° C.

When a solid black image was entirely formed on a sheet of copy paper by superimposing the three color toners, the end portions of the copy paper curled to a high degree.

When full-color images were formed on a transparent film for an overhead projector (OHP) and projected on a screen using the OHP, sharp full-color images were formed without muddiness.

In the case where a vinyl chloride sheet was brought into contact with the full-color-image bearing surface of the copy paper at room temperature for 180 hours, the toner images stuck to the vinyl chloride sheet. When the copy paper was forcibly separated from the vinyl chloride sheet, the full-color toner images were impaired.

Furthermore, a sample of each color toner weighing 10 g was placed in a 20-ml glass container and allowed to stand in a thermostat of 50° C. for 5 hours. As a result, all the toners set hard, and the penetration was zero.

In addition, when the image formation was carried out using these three toners under the circumstances of low humidity, the image density of the obtained toner images was considerably low.

Comparative Example 3

The procedure for preparation of the yellow, magenta and cyan toners according to the present invention in Example 1 was repeated except that the polyol resin No. 1 for use in each toner formulation in Example 1 was replaced by a commercially available epoxy resin "Epomik R-304" (Trademark), made by Mitsui Petrochemical Industries, Ltd. However, the melt viscosity of the toner composition, especially the yellow toner composition, was increased and each toner composition set hard in the heated roll mill in the course of kneading process. Therefore, it was impossible to fabricate the toners.

As previously explained, since the above specified polyol resin is employed as the binder resin for use in the electrophotographic dry toner of the present invention, stable image-fixing properties and preservability can be obtained, and the toner image can be formed in a stable condition regardless of the ambient conditions.

In the case where the toner image is formed on a sheet of copy paper using the dry toner according to the present invention, the toner image is not transferred to a vinyl chloride sheet while allowed to stand for a long period of time in such a condition that the toner image is brought into contact with the vinyl chloride sheet.

In addition, the toner of the present invention is used as a color toner, a proper glossiness can be imparted to the color toner image and the color reproduction is excellent. Furthermore, the curling of the toner-image-bearing copy paper can substantially be prevented.

Further, the previously mentioned polyol resin is stable to an amine-containing compound, so that there is no problem in the manufacturing process of the toner.

Japanese Patent Application No. 5-171505 filed on Jul. 12, 1993, and Japanese Patent Application No. 6-152054 filed on Jul. 4, 1994 are hereby incorporated by reference.

What is claimed is:

1. A dry toner for use in electrophotography comprising:

a coloring agent; and a polyol resin serving as a binder resin, which comprises (a) a main chain portion having a repeat unit, said main chain portion comprising an epoxy resin moiety and, in said repeat unit, at least two alkylene oxide moieties, and (b) protected terminal portions bonded to said main chain portion.

2. The dry toner as claimed in claim 1, wherein said polyol resin is a reaction product of:

(1) an epoxy resin;

(2) an alkylene oxide adduct of a dihydric phenol or a glycidyl ether of said alkylene oxide adduct;

(3) a compound including in the molecule thereof one active hydrogen atom which is capable of reacting with epoxy group, and (4) a compound including in the molecule thereof at least two active hydrogen atoms which are capable of reacting with epoxy group.

3. The dry toner as claimed in claim 2, wherein said epoxy resin comprises at least two kinds of bisphenol A type epoxy resin components with different number-average molecular weights, which are obtained by polymerizing bisphenol A as a polymerizable monomer.

4. The dry toner as claimed in claim 3, wherein the lowest of the number-average molecular weights of said bisphenol A type epoxy resin components is in the range from 360 to 2,000, and the highest of the number-average molecular weights of said bisphenol A type epoxy resin components is in the range from 3,000 to 10,000.

5. The dry toner as claimed in claim 3, wherein the amount of said bisphenol A type epoxy resin component with the lowest number-average molecular weight is in the range from 20 to 50 wt. % of the amount of said polyol resin, and the amount of said bisphenol A type epoxy resin component with the highest number-average molecular weight is in the range from 5 to 40 wt. % of the amount of said polyol resin.

6. The dry toner as claimed in claim 2, wherein said glycidyl ether of said alkylene oxide adduct is a diglycidyl ether of an alkylene oxide adduct of bisphenol A, with formula (1):

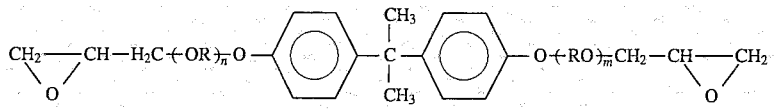
(1)
wherein R is
$$-CH_2-CH_2-,\quad -CH_2-\underset{\underset{CH_3}{|}}{CH}-,\quad \text{or}\quad -CH_2-CH_2-CH_2-;$$
and n and m are integers of 1 or more, provided that (n+m) is 2 to 6.
7. The dry toner as claimed in claim 2, wherein the amount of said alkylene oxide adduct of said dihydric phenol or said glycidyl ether of said alkylene oxide adduct is in the range of 10 to 40 wt. % of the amount of said polyol resin.
* * * * *